US005738012A

United States Patent [19]

Mètrope

[11] Patent Number: 5,738,012

[45] Date of Patent: Apr. 14, 1998

[54] DEVICE FOR FIXING A FLEXIBLE PRINTING FORM ON A FORM CYLINDER

[75] Inventor: Jacques Mètrope, Laigneville, France

[73] Assignees: Heidelberger Druckmaschinen AG, Heidelberg, Germany; Heidelberg Harris S.A., Montataire Cedex, France

[21] Appl. No.: 560,735

[22] Filed: Nov. 20, 1995

[30] Foreign Application Priority Data

Nov. 24, 1994 [FR] France ..... 94 14093

[51] Int. Cl.[6] ..... B41F 1/28

[52] U.S. Cl. ..... 101/415.1

[58] Field of Search ..... 101/415.1, 409

[56] References Cited

U.S. PATENT DOCUMENTS

| | | | |
|---|---|---|---|
| 3,727,551 | 4/1973 | Kostas et al. | 101/415.1 |
| 4,934,714 | 6/1990 | Lynch | 277/1 |
| 4,938,134 | 7/1990 | Dorsam et al. | 101/415.1 |
| 5,503,072 | 4/1996 | Schneider | 101/415.1 |
| 5,555,807 | 9/1996 | Pollet | 101/415.1 |

FOREIGN PATENT DOCUMENTS 0585625 3/1994 European Pat. Off. .

*Primary Examiner*—Edgar S. Burr
*Assistant Examiner*—Dave A. Ghatt
*Attorney, Agent, or Firm*—Herbert L. Lerner; Laurence A. Greenberg

[57] ABSTRACT

Device for fixing a flexible printing form on a form cylinder of a printing press, the form cylinder having at least one axially extending slit formed therein, and at least one leaf-shaped element disposed in the slit, the leaf-shaped element having a rounded end portion for securing a bent portion of a flexible form, includes a tubular support wherein the leaf-shaped element is disposed so as to form a fastening element, the tubular support accommodating an actuating member capable of resiliently deforming the fastening element.

12 Claims, 5 Drawing Sheets

Fig. 1
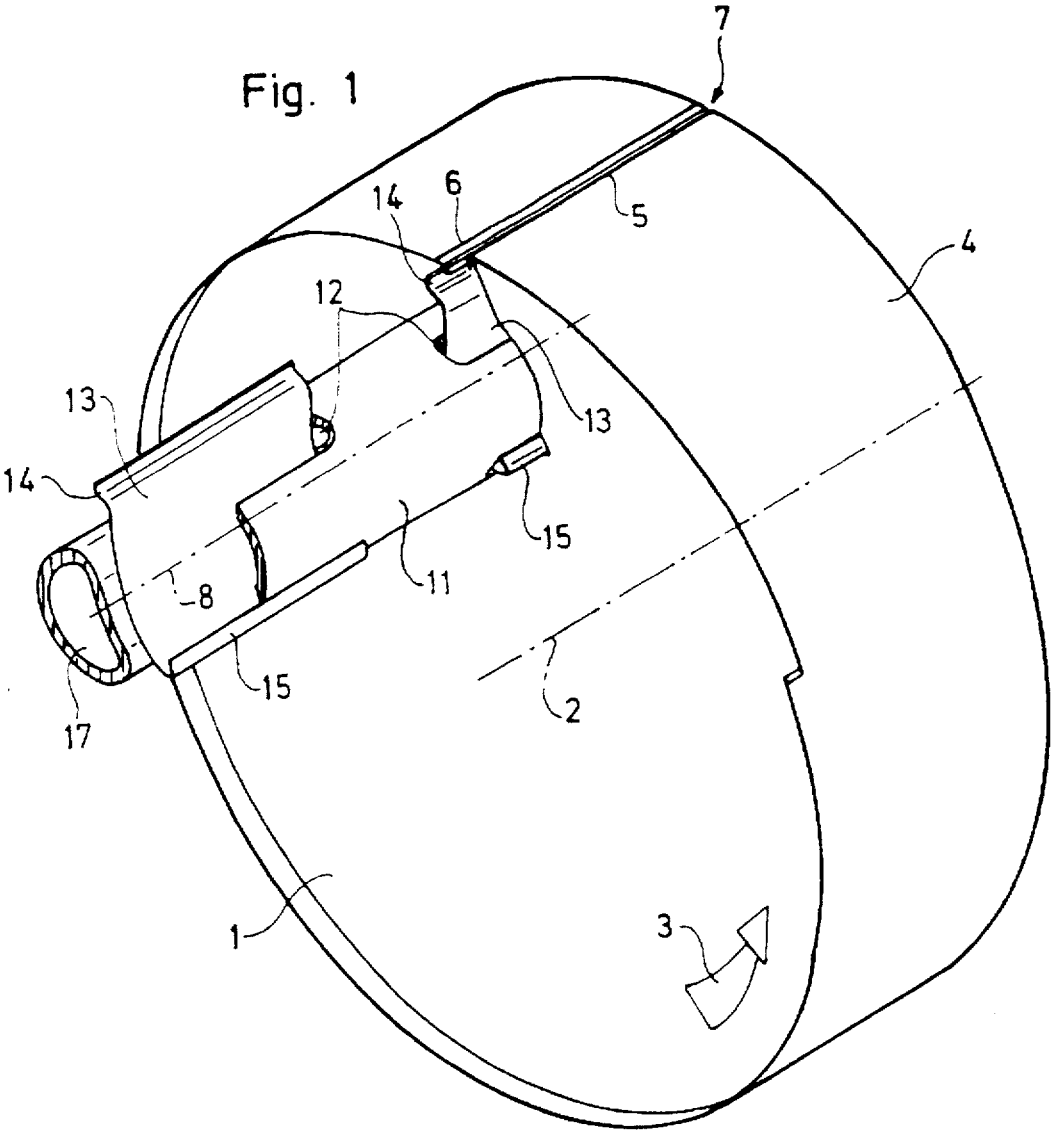
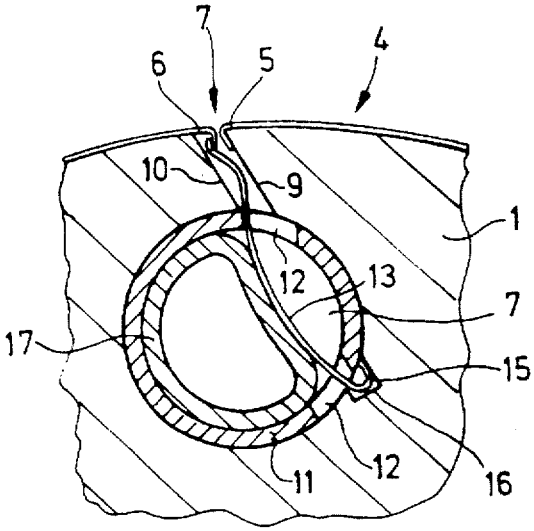
Fig. 2

Fig. 3
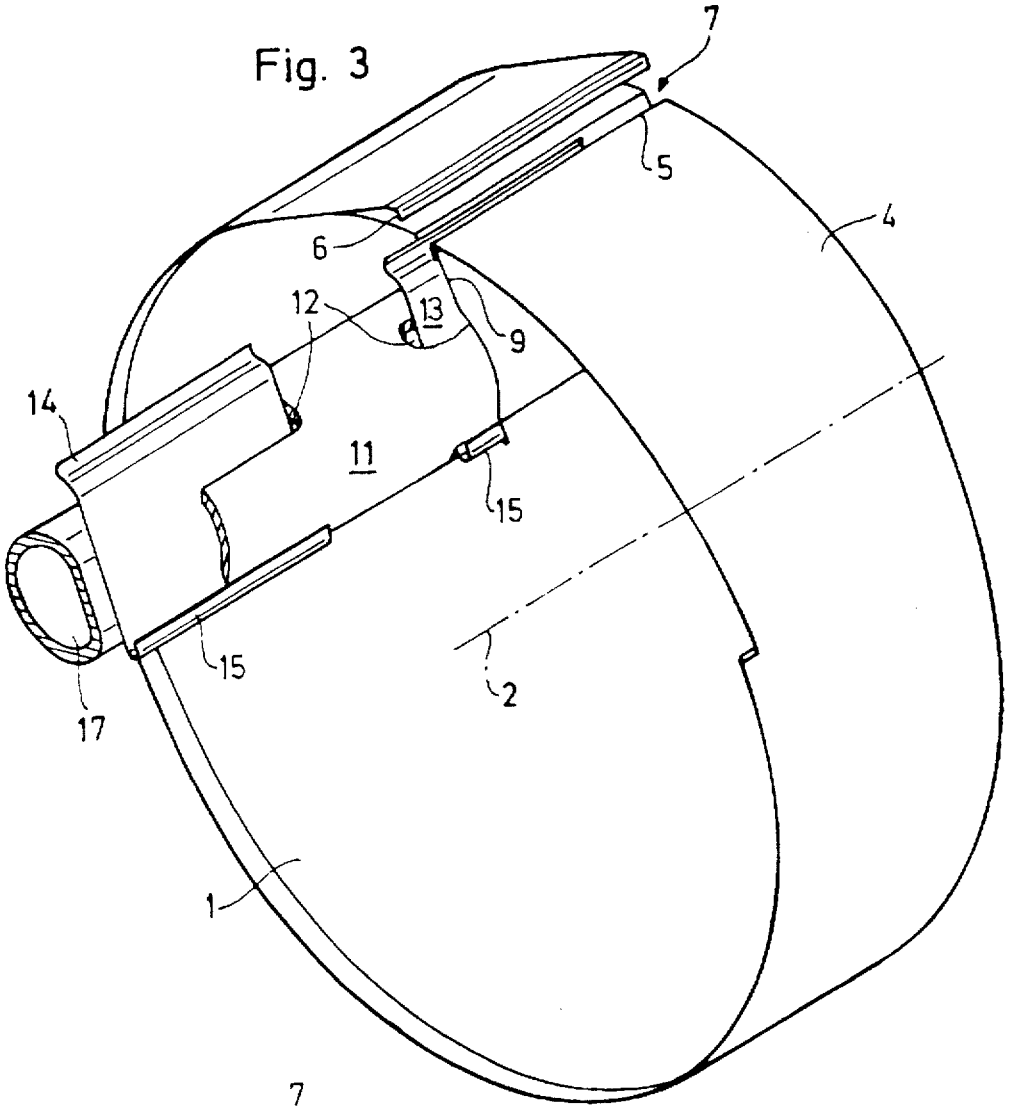
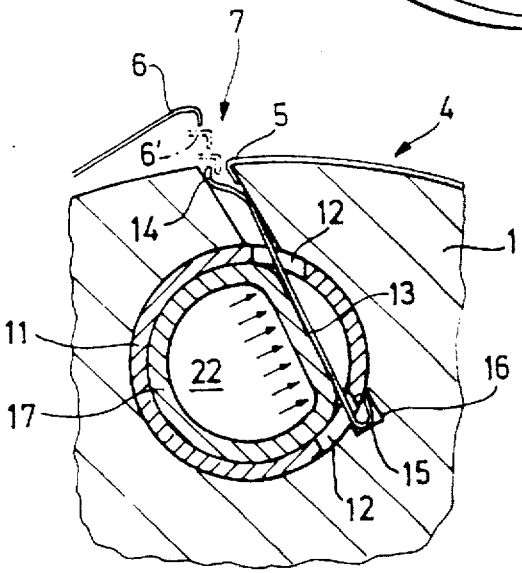
Fig. 4

DEVICE FOR FIXING A FLEXIBLE PRINTING FORM ON A FORM CYLINDER

BACKGROUND OF THE INVENTION

Field of the Invention

The invention relates to a device for fixing a flexible printing form on a form cylinder of a printing press, the form cylinder having at least one axially extending slit formed therein, and at least one leaf-shaped element disposed in the slit, the leaf-shaped element having a rounded end portion for securing a fold of a flexible form.

The published European Patent Document EP-A-0 585 625 has heretofore disclosed a device for fixing a flexible printing plate. The two ends of this printing plate are formed with bends by which the printing plate is fixed between a lateral wall of a slit formed in a plate cylinder and an extended arm of a leaf spring disposed in the slit. The leaf spring has a U-shaped form by which it is held in the slit of the plate cylinder, and is provided, in an upper part of an extended arm thereof, with a depression in the form of a groove. When the bent end of the printing plate is introduced, a protuberance formed on the respective bent end of the plate engages in a hollow formed below a rounded portion of the extended arm of the leaf spring. In addition to fixing the printing plate by friction, an assembly of the printing plate and the leaf spring is effected due to congruence of shape between the bent end of the plate and the leaf-spring arrangement.

Based upon the foregoing state of the art, it is accordingly an object of the invention to provide a device for fixing a flexible printing form on a form cylinder, the device having interchangeable fastening elements which are remotely actuatable with a view to fixing the printing form with a high degree of reliability.

SUMMARY OF THE INVENTION

With the foregoing and other objects in view, there is provided, in accordance with the invention, a device for fixing a flexible printing form on a form cylinder of a printing press, the form cylinder having at least one axially extending slit formed therein, and at least one leaf-shaped element disposed in the slit, the leaf-shaped element having a rounded end portion for securing a bent portion of a flexible form, comprising a tubular support wherein the leaf-shaped element is disposed so as to form a fastening element, the tubular support accommodating an actuating member capable of resiliently deforming the fastening element.

In accordance with another feature of the invention, the actuating member for deforming the fastening element is a deformable diaphragm body to which a pressurized fluid is applicable.

In accordance with a further feature of the invention, the actuating member for deforming the fastening element is a mechanical member.

In accordance with an added feature of the invention, the mechanical member is a pivoting control shaft having a circumferential surface and formed with a flattened portion on the circumferential surface thereof.

In accordance with an additional feature of the invention, the tubular support is rotatable in an axial bore formed in the form cylinder.

In accordance with yet another feature of the invention, the tubular support is formed with at least one pair of axially extending cut-outs.

In accordance with yet a further feature of the invention, the cut-outs are arranged facing one another in the tubular support.

In accordance with yet an added feature of the invention, the slit forms a fastening gap defined by lateral walls of the form cylinder and passing through an axial bore, the fastening gap having an aligned extension.

In accordance with yet an additional feature of the invention, the leaf-shaped fastening element is formed with a stop engaging in the extension of the fastening gap.

In accordance with still another feature of the invention, in a fastening position, the leaf-shaped fastening element bears against a wall defining the extension of the fastening gap and against an edge of the tubular support defining a cut-out formed in the tubular support and associated with the fastening gap.

In accordance with still a further feature of the invention, the slit forms a fastening gap defined by lateral walls of the form cylinder and passing through an axial bore, the fastening gap having an aligned extension, and the tubular support is rotatable in an axial bore formed in the form cylinder and, during rotation of the tubular support in an unlocking direction, the pair of cut-outs are aligned with the fastening gap and with the extension thereof, so that the leaf-shaped fastening element is removable in an unfastening direction.

In accordance with still an added feature of the invention, the tubular support accommodates a plurality of the leaf-shaped fastening elements distributed in axial direction.

In accordance with still an additional feature of the invention, the tubular support accommodates a leaf-shaped fastening element formed with openings distributed in axial direction.

In accordance with a concomitant feature of the invention, the tubular support accommodates a single leaf-shaped fastening element extending continuously in axial direction. By means of the device according to the invention, it is possible to deform fastening elements used to secure a printing form, the securing of the printing form during the normal operation of the machine being assured by the intrinsic rigidity of each resiliently deformable fastening element. The fastening of a flexible printing form on the form cylinder or the unfastening of the printing form therefrom is achieved by resilient deformation of each fastening element by means of the actuating member which is capable of remote actuation. Each fastening element which passes through the tubular support can be removed radially from the latter, following a simple unlocking movement of the the tubular support, and readily replaced with another fastening element.

According to one embodiment of the device according to the invention, the actuating member deforming each fastening element may be constructed in the form of a deformable diaphragm body which is subjected to a pressurized fluid, i.e., has a pressurized fluid applied thereto. According to another embodiment, the actuating member is a mechanical control member or device, such as a pivoting control shaft with a flat portion on the circumference thereof, for example. In order to facilitate the interchangeability of each fastening element, the tubular support accommodating the latter is mounted to pivot in an axial bore formed in the form cylinder. The tubular support is further formed with a number of pairs of cut-outs corresponding to the number of fastening elements to be accommodated, the cut-outs extending axially parallel to the axis of rotation of the form cylinder. The cut-outs are arranged facing each other in the tubular support. The slit of the the form cylinder constitutes a fastening gap or channel in which bent portions of the printing form engage, and which is delimited or defined by lateral walls of the slit and opens into the axial bore of the form cylinder which accommodates the tubular support. Opposite the fastening gap is an extension thereof aligned with the gap. Each leaf-shaped fastening element is formed with a stop which engages in the extension of the fastening gap. In the fastened position, each leaf-shaped fastening element bears against a wall defining the extension of the fastening gap and against an edge of the tubular support defining the upper cut-out associated with the fastening gap.

When the tubular support is rotated counter-clockwise, the pair of cut-outs is disposed in alignment with the fastening gap and with the extension thereof, so that each leaf-shaped fastening element can be removed in the unfastening direction.

Finally, according to alternative embodiments of the device according to the invention, individual fastening elements may be contemplated which can be disposed side by side in an axial direction or, alternatively, a single axially extending fastening element formed with individual openings. On the other hand, it is also possible to provide a single axially extending fastening element which is formed without any openings.

Other features which are considered as characteristic for the invention are set forth in the appended claims.

Although the invention is illustrated and described herein as embodied in a device for fixing a flexible printing form on a form cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE DRAWINGS

FIG. 1 is a diagrammatic perspective view of a form cylinder in a fixed or "fastened" position of a printing form;

FIG. 2 is an enlarged fragmentary diagrammatic sectional view of FIG. 1, showing in lateral section a tubular support for the leaf spring in the "fastened" position of the printing form;

FIG. 3 is a diagrammatic perspective view like that of FIG. 1, of a form cylinder in the "released" position of the printing form;

FIG. 4 is a diagrammatic view like that of FIG. 2, showing the tubular support with a stressed diaphragm in the "released" position of the printing form;

DESCRIPTION OF THE PREFERRED EMBODIMENTS

Figure 5:
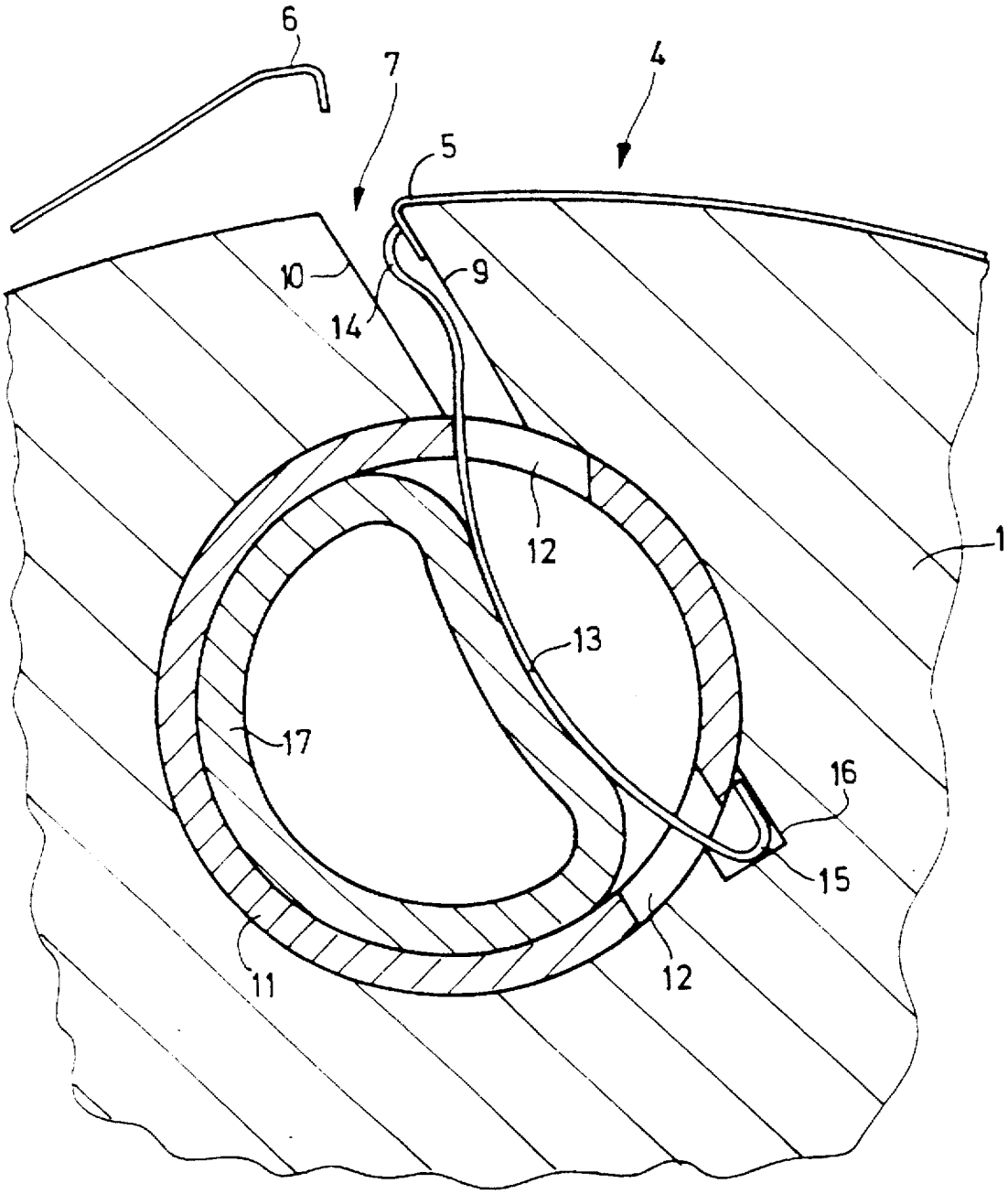
FIG. 5 is an enlarged diagrammatic view similar to that of FIG. 2, showing in lateral section the tubular support disposed in an axial bore formed in the form cylinder, and a trailing edge of the printing form in released condition, and a leading edge of the printing form in fastened condition.

Referring now to the drawings and, first, particularly to FIG. 1 thereof, there is shown therein a form cylinder 1 bearing on a peripheral surface thereof a printing form 4 having a leading edge 5 and a trailing edge 6 which are accommodated in a fastening gap or slit 7 formed in the form cylinder 1. The cylinder 1 rotates about its axis of rotation 2 in the direction of an arrow 3. The cylinder 1 is formed with an axial bore in which there is accommodated a tubular support 11 which extends along an axis 8 across the width of the cylinder 1, i.e., parallel to the rotational axis 2 thereof. As shown in FIG. 2, the fastening gap 7 defined by walls 9, 10 which, in this case, are parallel, opens into the axial bore accommodating the tubular support 11. It is apparent from the views of FIGS. 1 and 2 that cut-outs 12, shown juxtaposed in this case, are formed in the peripheral surface of the tubular support 11, and leaf-shaped fastening elements 13, such as leaf springs, for example, are secured in the cut-outs 12. The leaf-shaped fastening elements 13 are formed with a respective bent end shaped as a hook 15 at a lower end thereof, serving as a stop, and at an upper end thereof as a hook 14 for affixing or fastening the printing form 4. Each leaf-shaped fastening element 13 has a portion thereof situated between the hook 14 and the hook 15 serving as the stop, that portion of the fastening element 13 being located opposite an actuating member 17. The latter may constitute, for example, a deformable diaphragm subjected to a fluid pressure, or mechanical means, for example, a pivoting control shaft which is flattened on one side. This actuating member 17 is advantageously remotely controllable.

With reference to FIG. 2, the leading edge 5 of the printing form 4 is fastened in the fastening slit or gap 7 against one of the lateral walls 9 thereof. The bent trailing end 6 of the printing form 4 is gripped by the hook 14 of the leaf-shaped fastening element 13. In the "fastened" position shown, the actuating member, in this case a diaphragm 17, is not under pressure and the intrinsic rigidity of the leaf-shaped fastening element 13 pulls the trailing edge 6 of the flexible printing form 4 towards the interior of the fastening gap or slit 7 so as to keep the printing form 4, which is to be fixed, under tension in a tangential direction on the surface of the cylinder 1. The fastening gap or slit 7 has an extension 16. The cut-outs 12 of the tubular support 11 are positioned facing one another, and each leaf-shaped fastening element 13 passes through them. The leaf-shaped fastening element 13 is fixed, with the lower hook 15 thereof forming a stop, in the extension 16 of the fastening gap 7 and bears, above the curvature thereof, against the tubular support 11 at an edge of the upper cut-out 12. The actuating member 17 shown in this embodiment is not under pressure, a result of which is that the fastening force is applied and maintained by the intrinsic rigidity of the leaf-shaped fastening element 13.

In FIG. 3, it can be seen that the trailing edge 6, which is released by the leaf-shaped fastening elements 13, is situated above the surface of the cylinder 1. As FIG. 3 clearly shows, the curvature of the principal portion of the leaf-shaped fastening elements 13 is totally eliminated by the stressing of the actuating member 17 provided in this embodiment. As FIG. 4 in particular shows, in this state of release of the trailing edge 6 of the printing form, the actuating member 17 is under pressure. It is, for example, possible to use compressed air as the pressurized fluid 22. The actuating member 17 deforms the leaf-shaped fastening element 13 into a stretched position, wherein it remains fixed in the extension 16 of the fastening gap or slit 7 but moves through the upper cut-out 12 until it bears against the lateral wall 9 of the fastening gap 7. Due to this forced displacement of the leaf-shaped fastening element 13, the hook 14 moves rearward relative to the trailing edge 6 of the printing form 4, and releases the latter. The trailing edge 6 of the printing form 4 thus moves rapidly, through the position 6' shown in phantom, into the position thereof illustrated by solid lines in FIG. 4 above the surface of the form cylinder 1.

FIG. 5 shows the trailing end 6 of the printing form 4, disposed above the surface of the form cylinder 1. In this position, the actuating member 17, shown here as a deformable diaphragm, is not under pressure. Hence the hook 14 of the fastening element 13 forces the leading edge 5 of the printing form 4 against the lateral wall 9 of the fastening gap or slit 7, due to the intrinsic rigidity of the leaf-shaped fastening element 13. During the slow rotation of the form cylinder 1 in a clockwise direction, the printing form 4 can move slowly away from the surface of the form cylinder 1 and be introduced into an automatic or semi-automatic conventional plate-changing device. During this operation, the leading edge 5 of the printing form 4 remains permanently secured, because the leaf-shaped fastening element 13 is not subjected to any deformation and remains fixed, by the hook 15 thereof which forms a stop, in the extension 16 of the fastening gap or slit 7.

Figure 6:
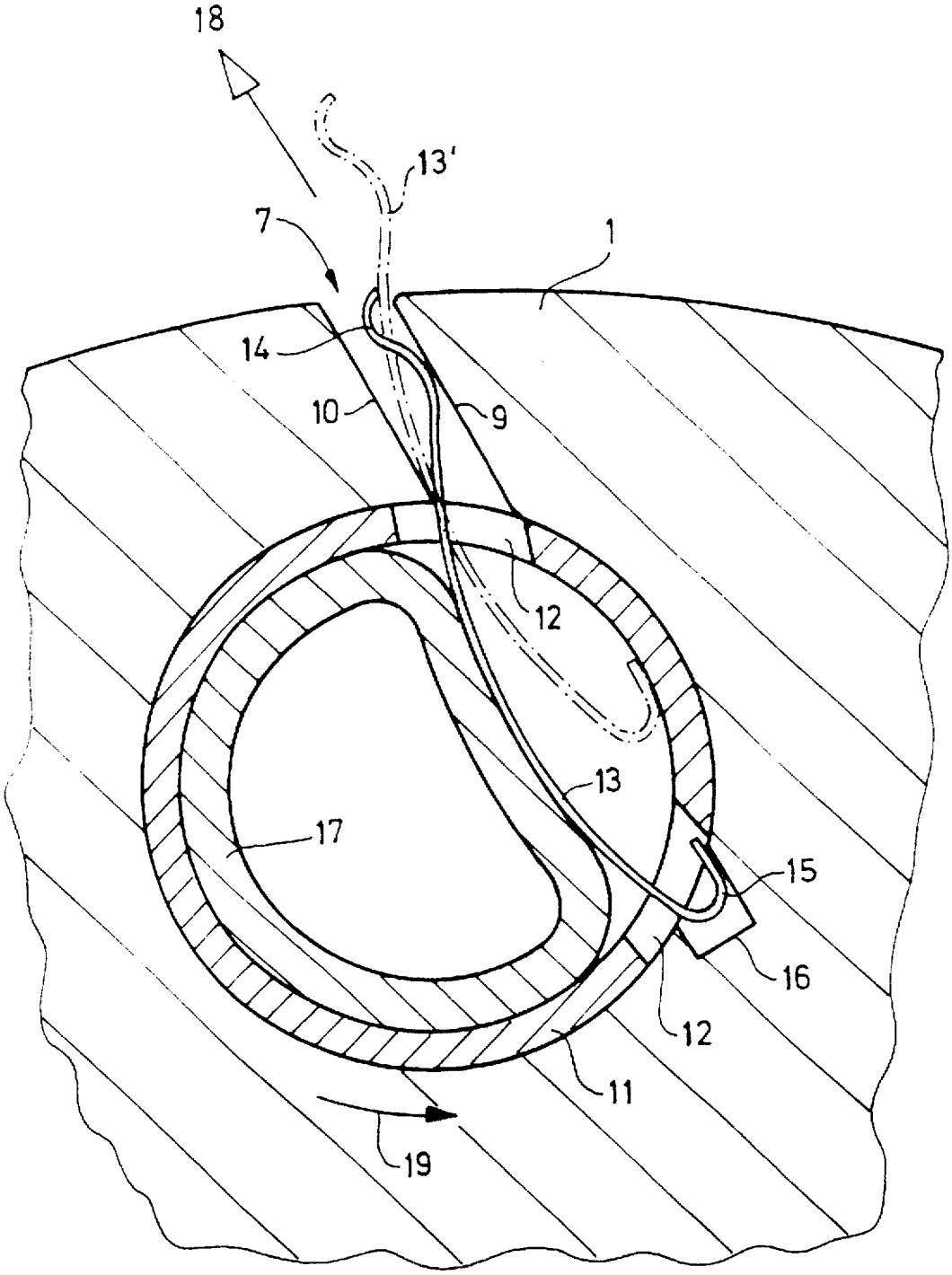
FIG. 6 is a diagrammatic view, in lateral section, like that of FIG. 5, showing the tubular support rotated into a position wherein each leaf-shaped fastening element is removable radially.

In the position shown in FIG. 6, the tubular support 11 rotates in the direction of the arrow 19. The extension 16 of the fastening gap or slit 7 then faces the lower cut-out 12, which enables the hook 15 forming the stop of the leaf-shaped fastening element 3 to pass through the lower cut-out 12. The leaf-shaped fastening element 13 can thus move, in an unfastening direction represented by the arrow 18, into the position 13' shown in phantom, when the actuating member 17 is not under pressure, and can then simply be removed from the fastening gap or slit 7. It would also be possible, for example, to introduce a fastening element with another spring characteristic into the tubular support 17 before the latter returns to the initial operating position thereof in a direction opposite to that of the arrow 19.

Figure 7:
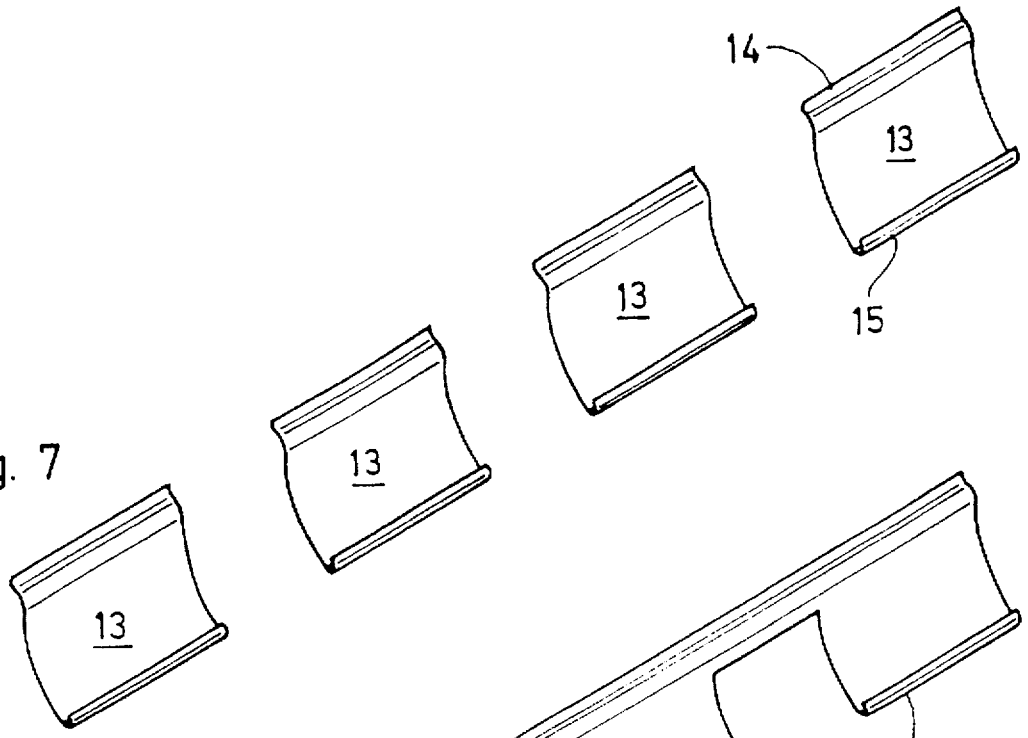
FIGS. 7, 8 and 9 are respective side elevational views of different embodiments of fastening elements of the device according to the invention which have different resilient properties.
Figure 8:
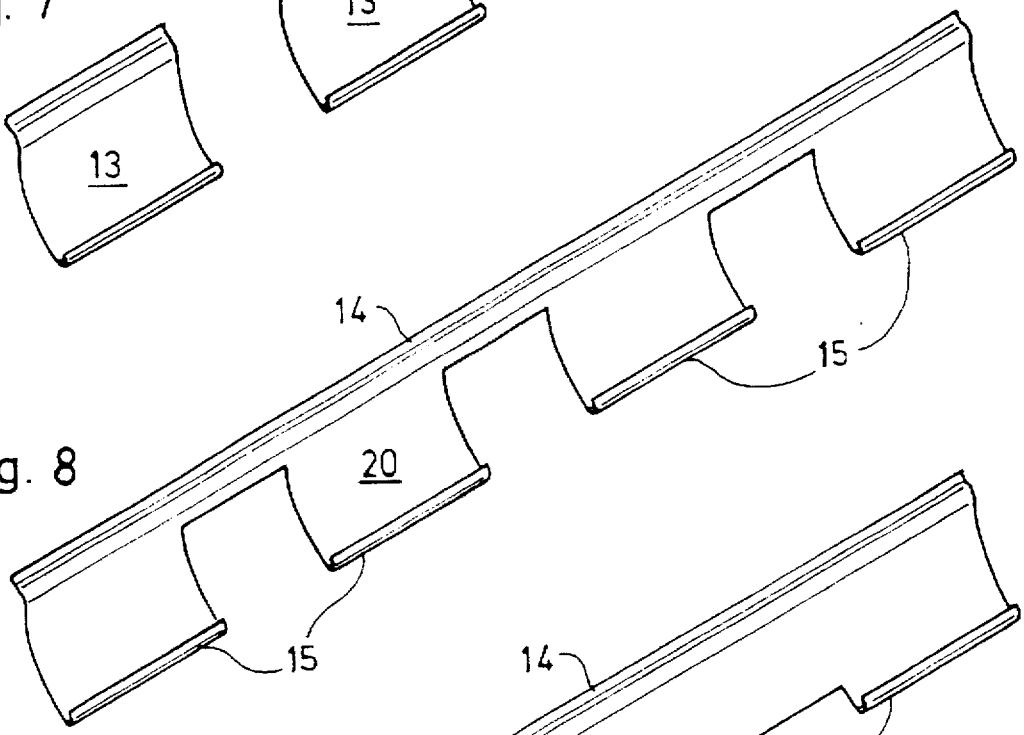
Figure 9:
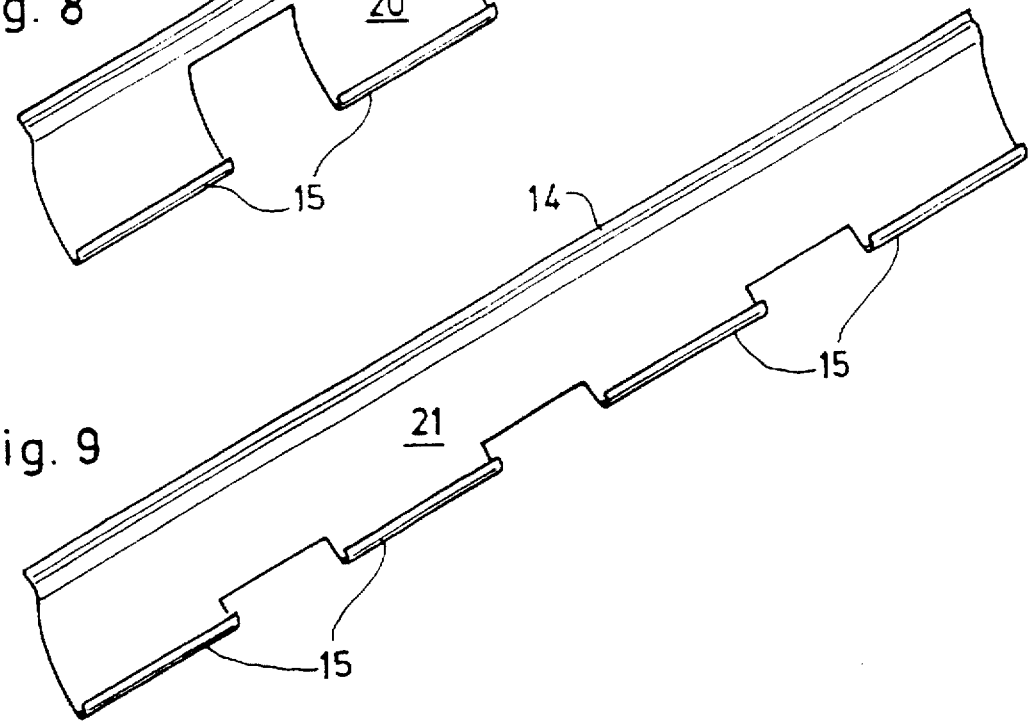

FIGS. 7, 8 and 9 show different embodiments of fastening elements which may be used in the device according to the invention.

Besides the fastening elements 13 already described hereinbefore, which are introduced side by side in an axial direction into a number of cut-outs 12 corresponding to their number, it is also possible to utilize continuous leaf-shaped fastening elements 20 or 21. Both of the latter can be provided with an end 14 bent in the form of a hook for securing the trailing edge 6 of a printing form 4, together with another end 15 bent in the form of a hook to form a stop. They may or may not also be provided with openings in the axial direction, following the necessary spring or clamping characteristics. It is obvious that the choice of material can also influence the spring characteristics.

The magnitude of the forces which need to be applied by the actuating member 17 depends upon the respective fastening elements which are used. Besides diaphragm pressure, it is also possible to use a pivoting control shaft with a flattened portion on one side to cause a deformation of the fastening elements 13, 20 and 21.

The invention of the instant application is in no way confined to the embodiments described and shown; persons skilled in the art will be able to envisage other alternative embodiment which suit their intent.

In particular, according to an alternative embodiment which is not illustrated herein, it is possible for each fastening element to be resiliently deformed by the actuating member in order to hold the flexible printing form on the form cylinder during the normal operation of the press, and for the fastening or unfastening of the flexible printing form to be achieved by the release of each fastening element which thus recovers its initial form and its intrinsic rigidity.

I claim:

1. Device for fixing a flexible printing form on a form cylinder of a printing press, the form cylinder having at least one axially extending slit formed therein, and at least one leaf-shaped element disposed in the slit, the leaf-shaped element having a rounded end portion for securing a bent portion of a flexible form, comprising a tubular support wherein the leaf-shaped element is disposed so as to form a fastening element, said tubular support accommodating an actuating member capable of resiliently deforming said fastening element.

2. Device according to claim 1, wherein said actuating member for deforming said fastening element is a deformable diaphragm body to which a pressurized fluid is applicable.

3. Device according to claim 1, wherein said tubular support is rotatable in an axial bore formed in the form cylinder.

4. Device according to claim 1, wherein said tubular support is formed with at least one pair of axially extending cut-outs.

5. Device according to claim 4, wherein said cut-outs are arranged facing one another in said tubular support.

6. Device according to claim 4, wherein the slit forms a fastening gap defined by lateral walls of the form cylinder and passing through an axial bore, said fastening gap having an aligned extension, and wherein said tubular support is rotatable in an axial bore formed in the form cylinder and, during rotation of said tubular support in an unlocking direction, said pair of cut-outs are aligned with said fastening gap and with said extension thereof, so that said leaf-shaped fastening element is removable in an unfastening direction.

7. Device according to claim 1, wherein the slit forms a fastening gap defined by lateral walls of the form cylinder and passing through an axial bore, said fastening gap having an aligned extension.

8. Device according to claim 7, wherein said leaf-shaped fastening element is formed with a stop engaging in said extension of said fastening gap.

9. Device according to claim 7, wherein, in a fastened position, said leaf-shaped fastening element bears against a wall defining said extension of said fastening gap and against an edge of said tubular support defining a cut-out formed in said tubular support and associated with said fastening gap.

10. Device according to claim 1, wherein said tubular support accommodates a plurality of said leaf-shaped fastening elements distributed in axial direction.

11. Device according to claim 1, wherein said tubular support accommodates a leaf-shaped fastening element formed with openings distributed in axial direction.

12. Device according to claim 1, wherein said tubular support accommodates a single leaf-shaped fastening element extending continuously in axial direction.

* * * * *